US012589840B2

(12) United States Patent
Parnell

(10) Patent No.: US 12,589,840 B2
(45) Date of Patent: Mar. 31, 2026

(54) ELECTRICALLY ACTUATED WATERSPORTS BOARD RACKS AND RELATED METHODS

(71) Applicant: Samson Sports LLC, Camas, WA (US)

(72) Inventor: Scott David Parnell, Camas, WA (US)

(73) Assignee: Samson Sports LLC, Camas, WA (US)

( * ) Notice: Subject to any disclaimer, the term of this patent is extended or adjusted under 35 U.S.C. 154(b) by 0 days.

(21) Appl. No.: 18/817,089

(22) Filed: Aug. 27, 2024

(65) Prior Publication Data

US 2025/0083775 A1 Mar. 13, 2025
US 2025/0304220 A9 Oct. 2, 2025

Related U.S. Application Data

(60) Provisional application No. 63/581,186, filed on Sep. 7, 2023.

(51) Int. Cl.
*B63B 32/83* (2020.01)
*A47B 81/00* (2006.01)

(52) U.S. Cl.
CPC ..... *B63B 32/83* (2020.02); *A47B 81/00* (2013.01)

(58) Field of Classification Search
CPC ..... A47B 81/00; A47B 81/005; B63B 32/83; B63B 25/002
See application file for complete search history.

(56) References Cited

U.S. PATENT DOCUMENTS

| | | | | |
|---|---|---|---|---|
| 4,863,082 | A * | 9/1989 | Evans | B63B 32/83 224/406 |
| 5,316,192 | A * | 5/1994 | Ng | B60R 9/048 224/324 |
| 6,886,795 | B2 * | 5/2005 | Schultz | B63B 32/83 248/316.1 |
| 7,896,175 | B1 * | 3/2011 | Corr | A63C 11/028 211/86.01 |
| 8,814,117 | B2 * | 8/2014 | Bohanan | B63B 32/80 248/316.1 |
| 9,055,826 | B2 * | 6/2015 | Curts | B63B 32/83 |
| 10,870,468 | B1 * | 12/2020 | Hellweg | B63B 32/40 |
| 11,873,063 | B1 * | 1/2024 | Boyd | B63B 32/83 |
| 12,037,086 | B2 * | 7/2024 | Lake | A47B 81/005 |
| 12,071,204 | B1 * | 8/2024 | Ramsdell | B63B 25/002 |
| 12,116,089 | B1 * | 10/2024 | Stuckey | B63B 32/83 |
| 12,122,487 | B2 * | 10/2024 | Wilson | B63B 32/83 |
| 2005/0155999 | A1 * | 7/2005 | Gasper | B60R 9/08 224/406 |

(Continued)

*Primary Examiner* — Stanton L Krycinski
(74) *Attorney, Agent, or Firm* — Kolitch Romano Dascenzo Gates LLP

(57) ABSTRACT

Electrically actuated watersports board racks and related methods are disclosed herein. The board racks include a board-receiving region configured to receive a watersports board and a retention structure. The retention structure is configured to be selectively actuated between a retained configuration, in which the retention structure is configured to apply a retention force to the watersports board to retain the watersports board within the board-receiving region, and a released configuration, in which the retention structure is configured to release the retention force. The retention structure includes an electrical actuator configured to selectively actuate the retention structure between the retained configuration and the released configuration.

16 Claims, 10 Drawing Sheets

(56) References Cited

U.S. PATENT DOCUMENTS

| | | | | |
|---|---|---|---|---|
| 2007/0209567 | A1* | 9/2007 | Fee | B63B 17/00 114/1 |
| 2015/0158431 | A1* | 6/2015 | Parnell | B60R 9/08 211/85.7 |
| 2022/0371699 | A1 | 11/2022 | Lake et al. | |
| 2024/0359777 | A1* | 10/2024 | Schultz | B63B 32/83 |

* cited by examiner

ELECTRICALLY ACTUATED WATERSPORTS BOARD RACKS AND RELATED METHODS

RELATED APPLICATION

This application claims priority to U.S. Provisional Patent Application No. 63/581,186, which was filed on Sep. 7, 2023, and the complete disclosure of which is hereby incorporated by reference.

FIELD OF THE DISCLOSURE

The present disclosure relates generally to electrically actuated watersports board racks and related methods.

BACKGROUND OF THE DISCLOSURE

Watersports board racks may be utilized to retain watersports boards and/or to attach the watersports boards to a watercraft, such as to a boat. Historically, watersports board racks have utilized a resilient member, such as a bungie cord, to retain the watersports boards. More recently, manually clamped watersports board racks, which utilize an integral clamping mechanism to retain the watersports boards, have been developed. While effective, these conventional watersports board racks suffer from a number of limitations. As an example, bungie cords may be cumbersome to utilize, may be lost, and/or may wear out. As another example, manually clamped watersports board racks may apply too much clamping force, thereby damaging the watersports boards, may be difficult for small individuals to operate, and/or may require separate actuation of multiple clamping mechanisms in order to insert and/or remove a single watersports board. Thus, there exists a need for improved watersports board racks, such as the electrically actuated watersports board racks disclosed herein.

SUMMARY OF THE DISCLOSURE

Electrically actuated watersports board racks and related methods are disclosed herein. The board racks include a board-receiving region configured to receive a watersports board and a retention structure. The retention structure is configured to be selectively actuated between a retained configuration, in which the retention structure is configured to apply a retention force to the watersports board to retain the watersports board within the board-receiving region, and a released configuration, in which the retention structure is configured to release the retention force. The retention structure includes an electrical actuator configured to selectively actuate the retention structure between the retained configuration and the released configuration.

The methods include selectively actuating an electrical actuator to selectively transition a retention structure of the watersports board rack between a retained configuration, in which the retention structure is configured to apply a retention force to a watersports board to retain the watersports board within a board-receiving region, and a released configuration, in which the retention structure is configured to release the retention force. The selectively actuating includes selectively transitioning the watersports board rack from the retained configuration to the released configuration via compression of an engagement pad biasing mechanism of the retention structure and also includes selectively transitioning the watersports board rack from the released configuration to the retained configuration via permitting expansion of the engagement pad biasing mechanism of the retention structure. The retention force is generated solely by the engagement pad biasing mechanism.

DETAILED DESCRIPTION AND BEST MODE OF THE DISCLOSURE

Figure 1:
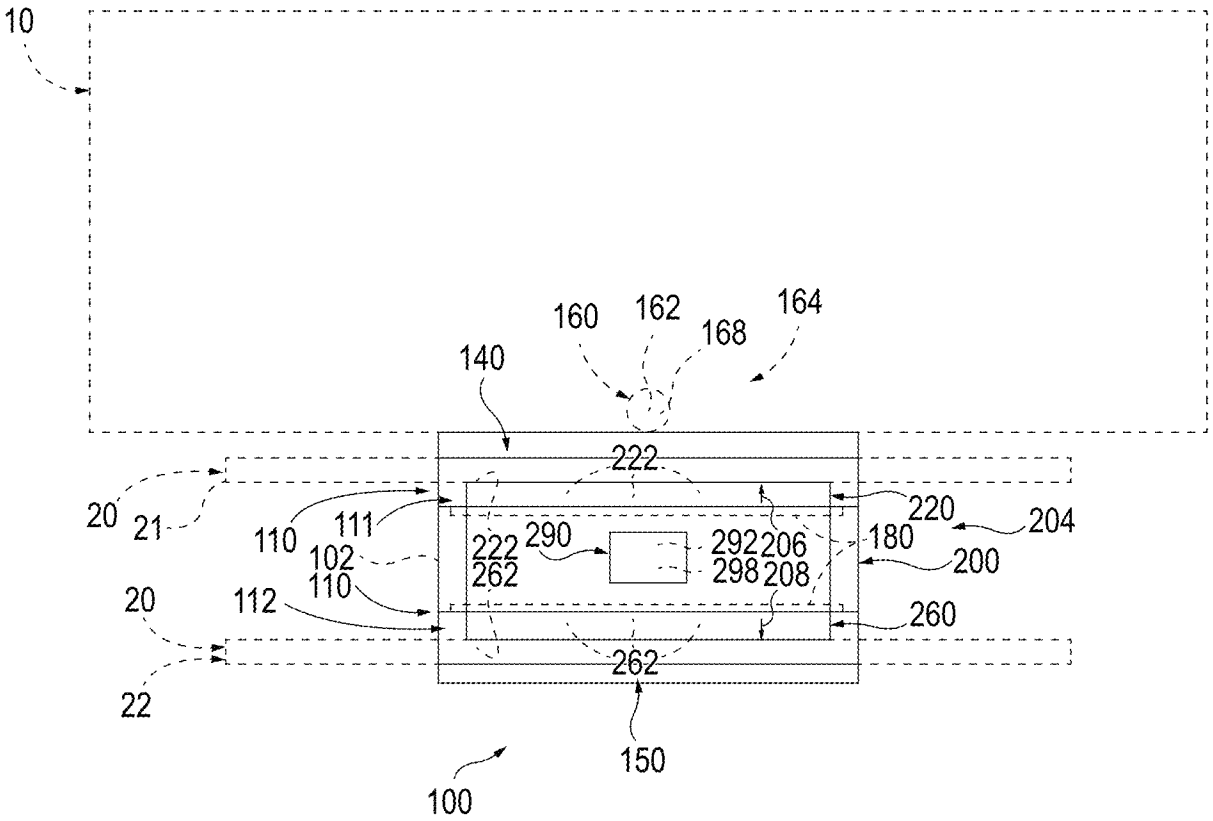
FIG. 1 is a schematic illustration of examples of a watersports board rack attached to a watercraft and in a stowed orientation, according to the present disclosure.

FIGS. 1-10 provide examples of electrically actuated watersports board racks 100, which also may be referred to herein as watersports board racks 100 and/or as board racks 100. Watersports board racks 100 are configured to support watersports boards 20, and/or to be used with watercraft 10 that include watersports board racks 100, according to the present disclosure. Elements that serve a similar, or at least substantially similar, purpose are labeled with like numbers in each of FIGS. 1-10, and these elements may not be discussed in detail herein with reference to each of FIGS. 1-10. Similarly, all elements may not be labeled in each of FIGS. 1-10, but reference numerals associated therewith may be utilized herein for consistency. Elements, components, and/or features that are discussed herein with reference to one or more of FIGS. 1-10 may be included in and/or utilized with any of FIGS. 1-10 without departing from the scope of the present disclosure.

In general, elements that are likely to be included in a particular embodiment are illustrated in solid lines, while elements that are optional are illustrated in dashed lines. However, elements that are shown in solid lines may not be essential to all embodiments and, in some embodiments, may be omitted without departing from the scope of the present disclosure.

Figure 2:
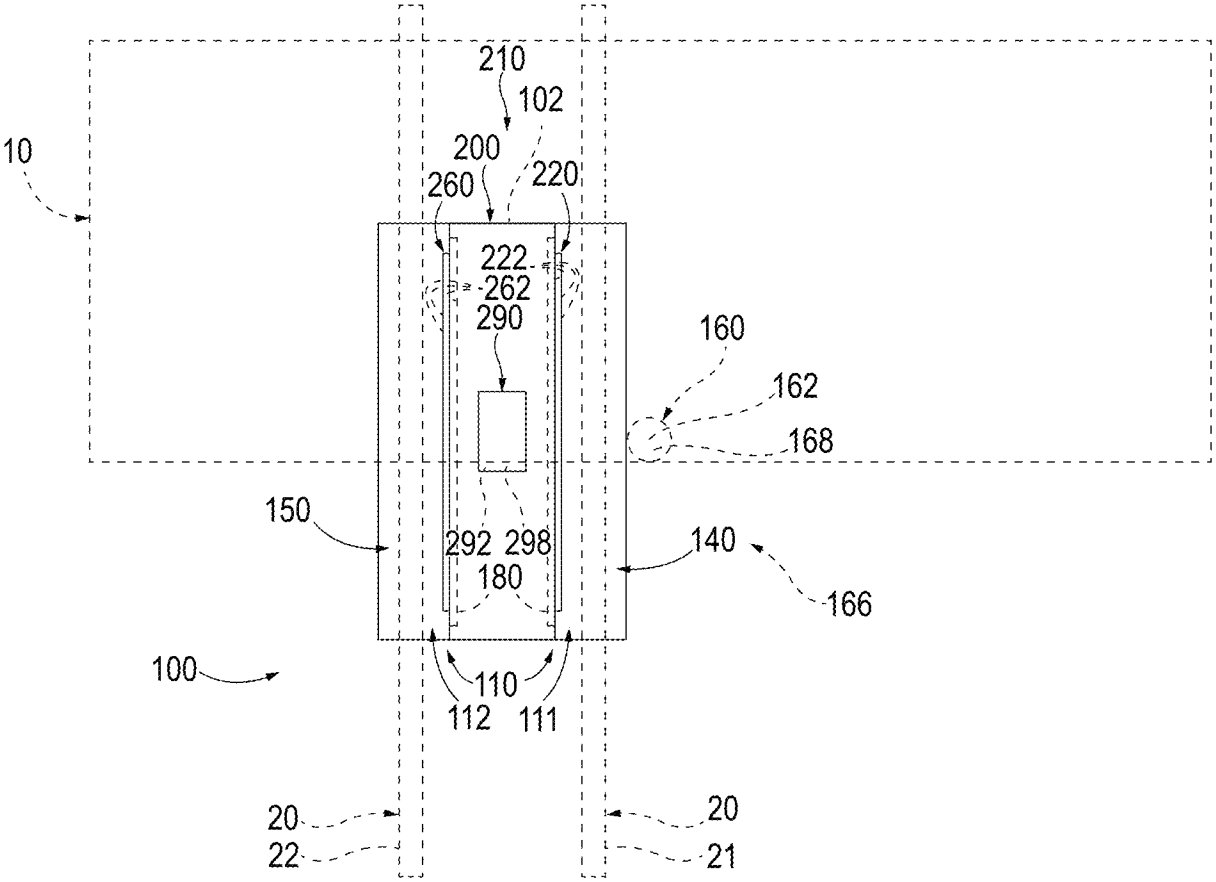
FIG. 2 is a schematic illustration of examples of the watersports board rack of FIG. 1 in a deployed orientation.

As collectively illustrated by FIGS. 1-10, and with specific reference to FIGS. 1-2, watersports board racks 100, according to the present disclosure, include a board-receiving region 110 configured to support a watersports board 20. Watersports board racks 100 also may be referred to herein as board racks 100, and examples of watersports boards 20 include wakeboards, wakesurf boards, water skis, kneeboards, and/or hydrofoils.

Board racks 100 may be configured to be operatively attached to a watercraft 10, as perhaps best illustrated in FIGS. 1-2, such as to permit and/or to facilitate storage and/or use of watersports boards 20 with the watercraft and/or while the watercraft is on the water. Examples of watercraft 10 include a boat, wakeboard boat, and/or a ski boat.

To permit and/or facilitate attachment of board racks 100 to watercraft 10, the board racks may include a mounting structure 160, which may be configured to operatively attach the board racks to the watercraft. Examples of mounting structure 160 include a clamp, a pipe clamp, and/or a fastener. In some examples, mounting structure 160 may include a pivot 162, which may be configured to permit and/or facilitate adjustment of board racks 100 between a stowed configuration 164, as illustrated in FIG. 1, and a deployed configuration 166, as illustrated in FIG. 2. In some such examples, mounting structure 160 also may include a lock 168, which may be configured to selectively retain the board rack in stowed configuration 164 and/or in deployed configuration 166. Examples of pivot 162 include a hinge mechanism, a single-axis pivot mechanism, a multi-axis pivot mechanism, and/or a gimbal. Examples of lock 168 include a set screw, a pin, a sliding pin, a biased pin, and/or a keyed locking mechanism.

As discussed, board racks 100 include at least one board-receiving region 110, which is configured to receive watersports boards 20. In specific examples, board racks 100 may include a plurality of board-receiving regions 110, including a first board-receiving region 111, which is configured to receive a first watersports board 21, and a second board-receiving region 112, which is configured to receive a second watersports board 22.

Board racks 100 also include a retention structure 200. Retention structure 200 is configured to be selectively actuated between a retained configuration 204, which is illustrated in solid lines in FIGS. 1, 3-4, and 8-10 and a released configuration 210, which is illustrated in solid lines in FIG. 2, in dashed lines in FIGS. 3-4, and in solid lines in FIGS. 5-7.

Figure 3:
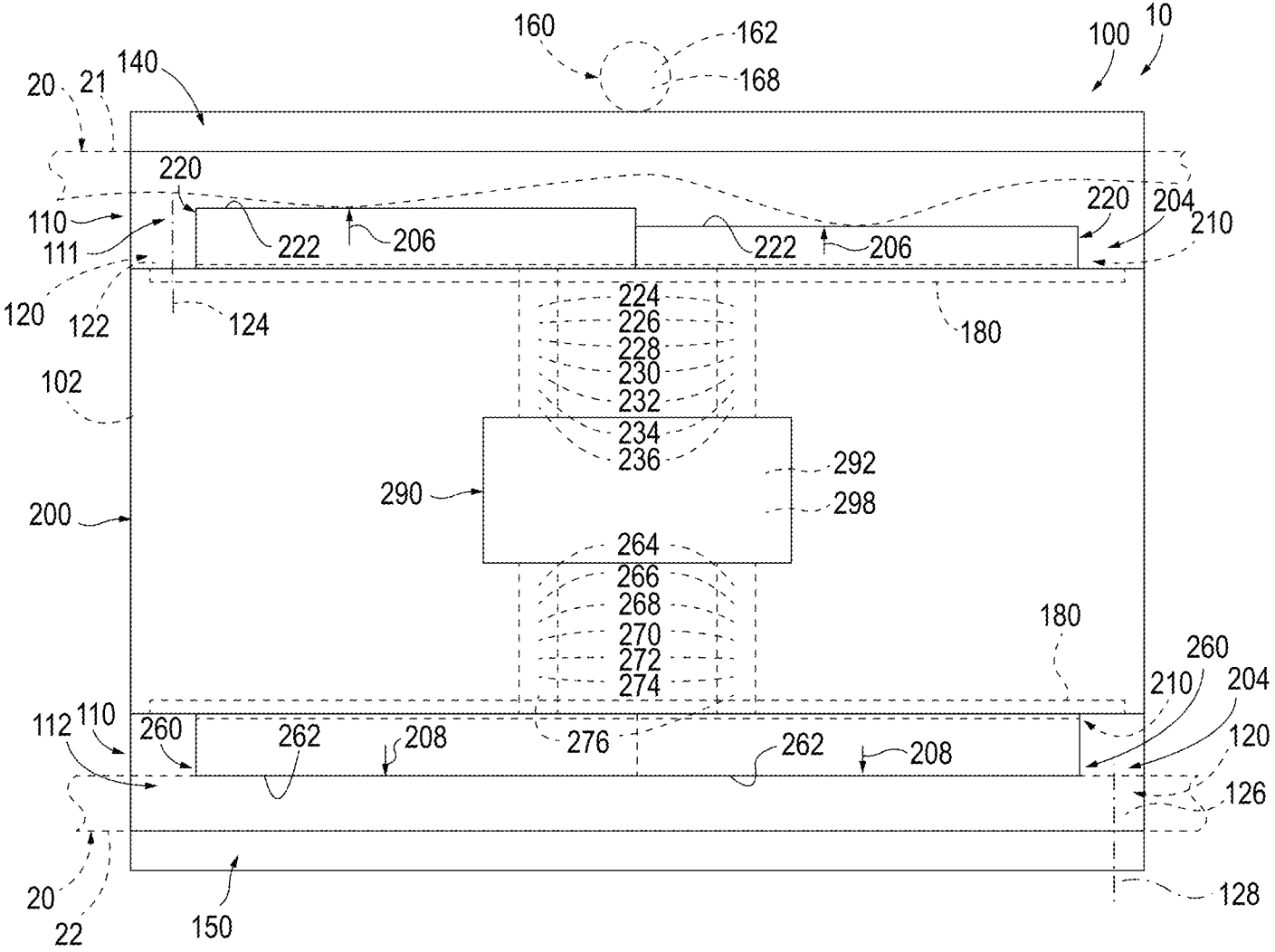
FIG. 3 is a schematic top view illustrating more detailed examples of the watersports board rack of FIGS. 1-2.
Figure 4:
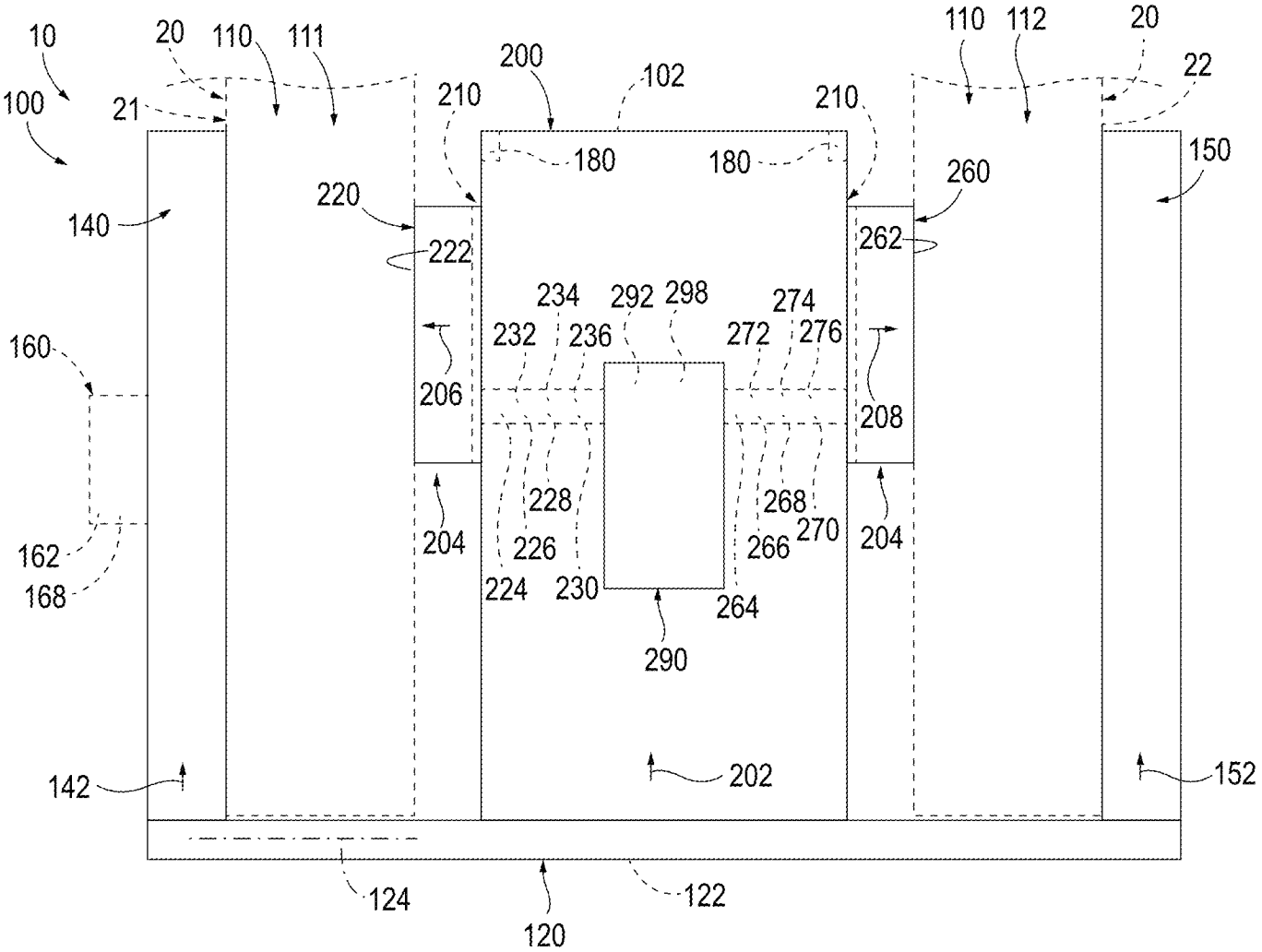
FIG. 4 is a schematic side view illustrating more detailed examples of the watersports board rack of FIGS. 1-3.

When in retained configuration 204, retention structure 200 is configured to apply a retention force to watersports boards 20, such as to retain the watersports boards within the corresponding board-receiving region 110. In the specifically illustrated examples, retention structure 200 applies a first retention force 206 to first watersports board 21 to retain the first watersports board within first board-receiving region 111, as illustrated in FIGS. 1 and 3-4. In addition, retention structure 200 applies a second retention force 208 to second watersports board 22 to retain the second watersports board within second board-receiving region 112, as also illustrated in FIGS. 1 and 3-4.

When in released configuration 210, retention structure 200 releases, or does not apply, the first retention force and/or the second retention force. Stated differently, when in released configuration 210, retention structure 200 is configured to permit, or not to resist, insertion and/or removal of watersports boards 20 from corresponding board-receiving regions 110. However, when in retained configuration 204, retention structure 200 is configured to retain the watersports boards within the corresponding board-receiving regions and/or to resist removal of the watersports boards from the corresponding board-receiving regions.

Retention structure 200 also includes an electrical actuator 290. Electrical actuator 290 is configured to selectively actuate retention structure 200 between retained configuration 204 and released configuration 210.

It is within the scope of the present disclosure that board racks 100 may hold and/or retain watersports boards 20 at any suitable orientation, or relative orientation. This may include horizontal, or at least substantially horizontal, orientations, vertical, or at least substantially vertical, orientations, or any other suitable orientation, such as may be between vertical and horizontal. In a specific example, and when board rack 100 includes two board-receiving regions 110, first board-receiving region 111 may be configured to receive and/or to retain first watersports board 21 in a horizontal, or at least substantially horizontal, first board orientation; and second board-receiving region 112 may be configured to receive and/or to retain second watersports board 22 in a horizontal, or at least substantially horizontal, second board orientation. Alternatively, first board-receiving region 111 may be configured to receive and/or to retain first watersports board 21 in a vertical, or at least substantially vertical, first board orientation; and second board-receiving region 112 may be configured to receive and/or to retain second watersports board 22 in a vertical, or at least substantially vertical, second board orientation. Additionally or alternatively, the first board-receiving region and the second board-receiving region may be configured to retain the first watersports board and the second watersports board parallel, or at least substantially parallel, to one another.

As illustrated, board-receiving regions 110, including first board-receiving region 111 and/or second board-receiving region 112 may be U-shaped, or at least substantially U-shaped. Stated differently, board-receiving regions 110 may be configured to surround, or to at least partially surround, three sides of corresponding watersports boards 20 that are inserted and/or retained therein.

As an example, and with specific reference to FIGS. 4-6 and 8-9, board racks 100 may include a base region 120, a first projecting region 140, and a second projecting region 150. Base region 120 may define, or at least partially define, both first board-receiving region 111 and second board-receiving region 112. First projecting region 140 may extend from base region 120 and/or may define, or at least partially define, first board-receiving region 111. Similarly, second projecting region 150 may extend from base region 120 and/or may define, or at least partially define, second board-receiving region 112.

In some such examples, first projecting region 140 may extend from base region 120 in a first projection direction 142 and second projecting region 150 may extend from base region 120 in a second projection direction 152. The first projection direction and the second projection direction may be parallel, or at least substantially parallel, to one another.

Retention structure 200 may extend from base region 120. In some examples, retention structure 200 extends from base region 120 in a retention structure projection direction 202, which may be parallel, or at least substantially parallel, to first projection direction 142 and/or to second projection direction 152. In some examples, retention structure 200 may extend between, at least partially between, and/or directly between first projecting region 140 and second projecting region 150. In some examples, retention structure 200 may define, or at least partially define, both first board-receiving region 111 and second board-receiving region 112. Stated differently, base region 120, first projecting region 140, and retention structure 200 together may define, or at least partially define, first board-receiving region 111. Similarly, base region 120, second projecting region 150, and retention structure 200 together may define, or at least partially define, second board-receiving region 112.

With the above in mind, and when retention structure 200 is in retained configuration 204, board rack 100 may apply a first compressive force to first watersports board 21 via retention structure 200 and first projecting region 140. In addition, board rack 100 may apply a second compressive force to second watersports board 22 via retention structure 200 and second projecting region 150. In some such examples, first projecting region 140 may include and/or be a resilient, a flexible, and/or a spring-loaded first projecting region, such as may be configured to limit a magnitude of the first compressive force. Similarly, second projecting region 150 may include and/or be a resilient, a flexible, and/or a spring-loaded second projecting region, such as may be configured to limit a magnitude of the second compressive force. Such a configuration may decrease a potential for deformation and/or damage to watersports boards 20 via application of the compressive forces.

Figure 5:
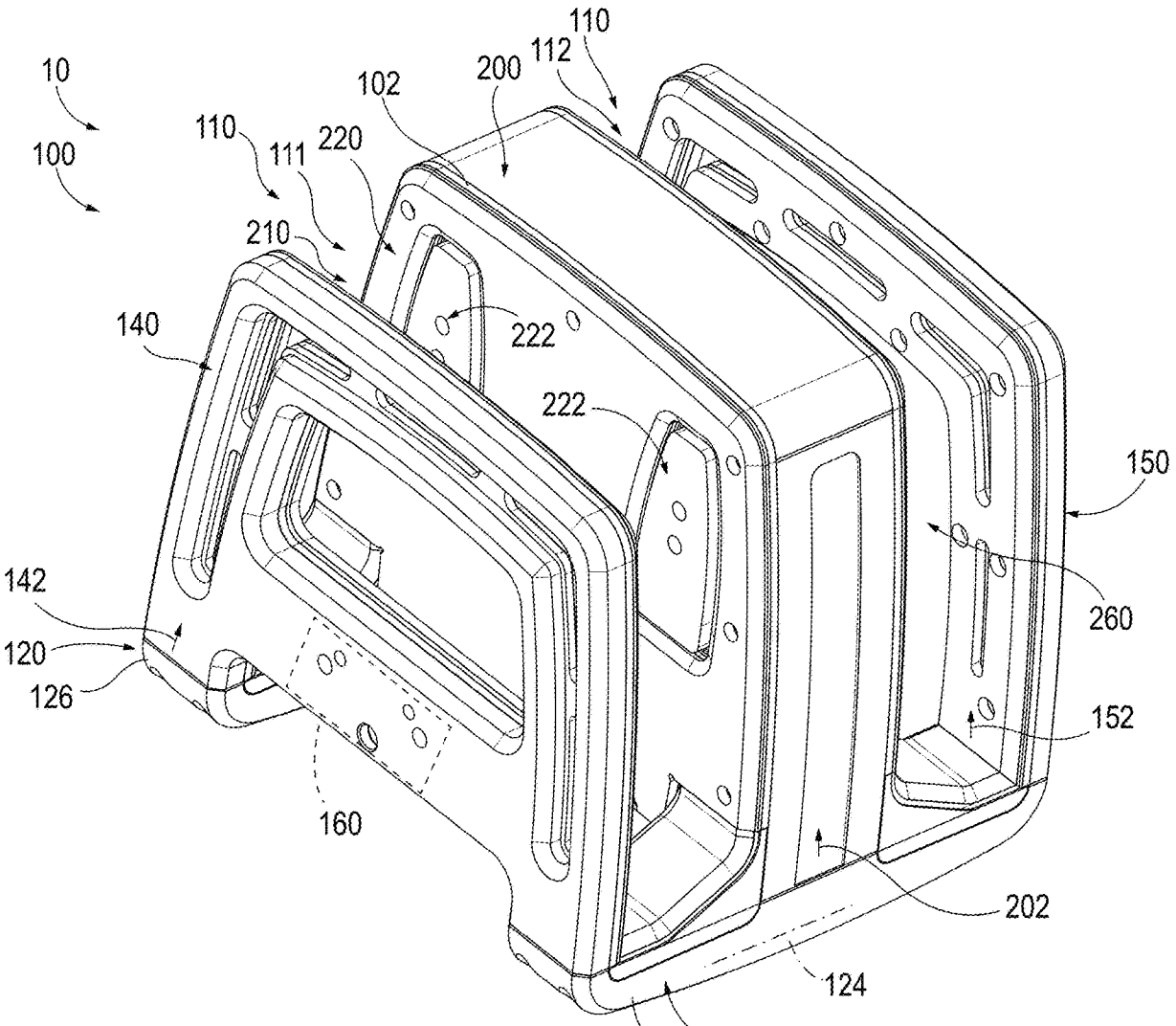
FIG. 5 is a less schematic profile view illustrating examples of a watersports board rack in a released configuration, according to the present disclosure.
Figure 8:
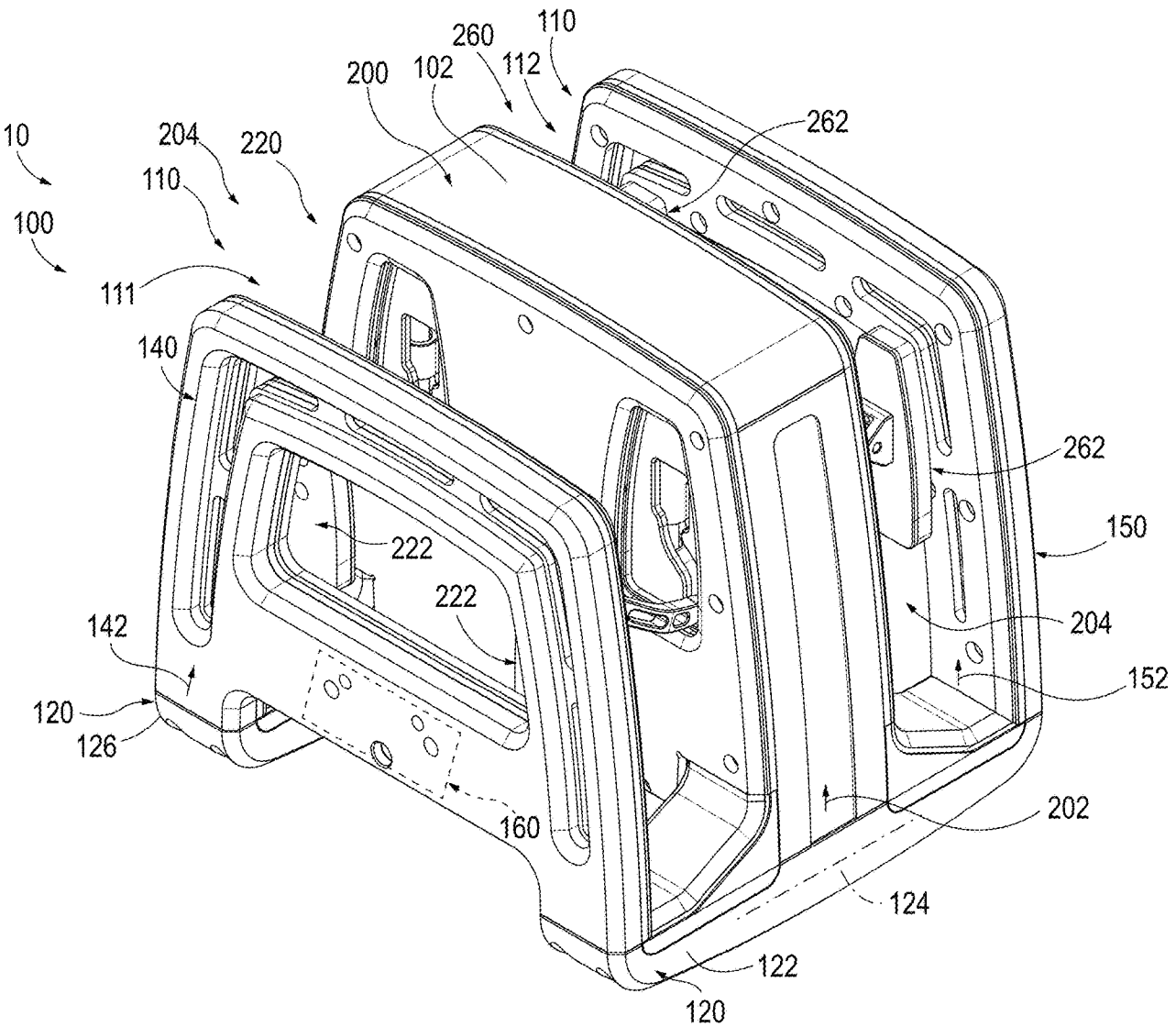
FIG. 8 is a less schematic profile view illustrating examples of the watersports board rack of FIGS. 5-7, but in a retained configuration.

As perhaps best illustrated in FIGS. 3, 5, and 8, and in some examples, board racks 100 may include a plurality of base regions 120, including at least a first base region 122 and a second base region 126. In such an example, a longitudinal axis 124 of first base region 122 may extend parallel, or at least substantially parallel, to a longitudinal axis 128 of second base region 126, as perhaps best illustrated in FIG. 3. Additionally or alternatively, both first base region 122 and second base region 126 may define, or at least partially define, both first board-receiving region 111 and second board-receiving region 112. Additionally or alternatively, first projecting region 140, second projecting region 150, and/or retention structure 200 may extend from and/or may be operatively attached to both first base region 122 and second base region 126.

Retention structure 200 may be configured to apply first retention force 206 in a first retention force direction, such as may be indicated by the arrow in FIGS. 1 and 3-4. In addition, retention structure 200 may be configured to apply second retention force 208 in a second retention force direction, such as may be indicated by the arrow in FIGS. 1 and 3-4. The first retention force direction may be opposed, at least substantially opposed, away from, at least substantially away from, and/or directly away from the second retention force direction.

In some examples, retention structure 200 may be configured to apply the first retention force with a predetermined first retention force magnitude and/or within a predetermined first retention force magnitude range. The predetermined first retention force magnitude may be independent of a thickness of the first watersports board. Similarly, retention structure 200 may be configured to apply the second retention force with a predetermined second retention force magnitude and/or within a predetermined second retention force magnitude range. The predetermined second retention force magnitude may be independent of a thickness of the second watersports board.

As an example, and as discussed in more detail herein, retention structure 200 may include a first engagement pad biasing mechanism 224, which may be configured to provide the first retention force, and/or a second engagement pad biasing mechanism 264, which may be configured to provide the second retention force. As also discussed in more detail herein, the first engagement pad biasing mechanism and/or the second engagement pad biasing mechanism may be configured to provide, or only to provide, the first retention force and the second retention force within the first predetermined retention force range and the second predetermined retention force range, respectively. Such a configuration may permit application of controlled and/or regulated retention forces to corresponding watersports boards, thereby decreasing a potential for damage to and/or deformation of the watersports boards by the board rack and/or when the watersports boards are retained within the board rack.

Retention structure 200 may include any suitable structure that may be adapted, configured, designed, sized, and/or constructed to selectively transition between the retained configuration and the released configuration, to selectively retain watersports boards 20, and/or to be selectively actuated by electrical actuator 290. As an example, and as collectively illustrated by FIGS. 1-6 and 8-9, retention structure 200 may include a first engagement structure 220 and a second engagement structure 260. First engagement structure 220 may be configured to selectively apply first retention force 206 to the first watersports board, and second engagement structure 260 may be configured to selectively apply second retention force 208 to the second watersports board.

In some examples, first engagement structure 220 may include a pair of first engagement pads 222, and second engagement structure 260 may include a pair of second engagement pads 262. First engagement pads 222 may be configured to contact the first watersports board and/or to apply the first retention force to the first watersports board. Similarly, second engagement pads 262 may be configured to contact the second watersports board and/or to apply the second retention force to the second watersports board. Stated differently, each first engagement pad of the pair of first engagement pads may apply a corresponding fraction of the first engagement force, and each second engagement pad in the pair of second engagement pads may apply a corresponding fraction of the second engagement force.

As illustrated in FIGS. 3-4, 6-7, and 9-10, retention structure 200 also may include a pair of first engagement pad biasing mechanisms 224 and a pair of second engagement pad biasing mechanisms 264, examples of which include resilient members, springs, and/or coil springs. In such a configuration, each engagement pad of the pair of first engagement pads 222 may be independently biased to apply the corresponding fraction of the first retention force via a corresponding one of the pair of first engagement pad biasing mechanisms 224. Similarly, each engagement pad of the pair of second engagement pads 262 may be independently biased to apply the corresponding fraction of the second retention force via a corresponding one of the pair of second engagement pad biasing mechanisms 264. This may permit and/or facilitate application of retention forces, such as the first retention force and/or the second retention force, of a desired magnitude, such as the first retention force magnitude and/or the second retention force magnitude, independent of a shape and/or thickness of the corresponding watersports board.

As an example, and as illustrated within first board-receiving region 111 of FIG. 3, a corresponding watersports board 20, such as first watersports board 21, may have a nonuniform and/or tapered shape along a length thereof, and first engagement structure 220 may accommodate and/or account for this nonuniform shape by extending first engagement pads 222 different distances to contact the first watersports board. Alternatively, second watersports board 22 that is within second board-receiving region 112 of FIG. 3 illustrates an example where the watersports board has a uniform and/or constant shape along the length thereof. In such a configuration, second engagement pads 262 may extend the same distance to contact the second watersports board.

Figure 6:
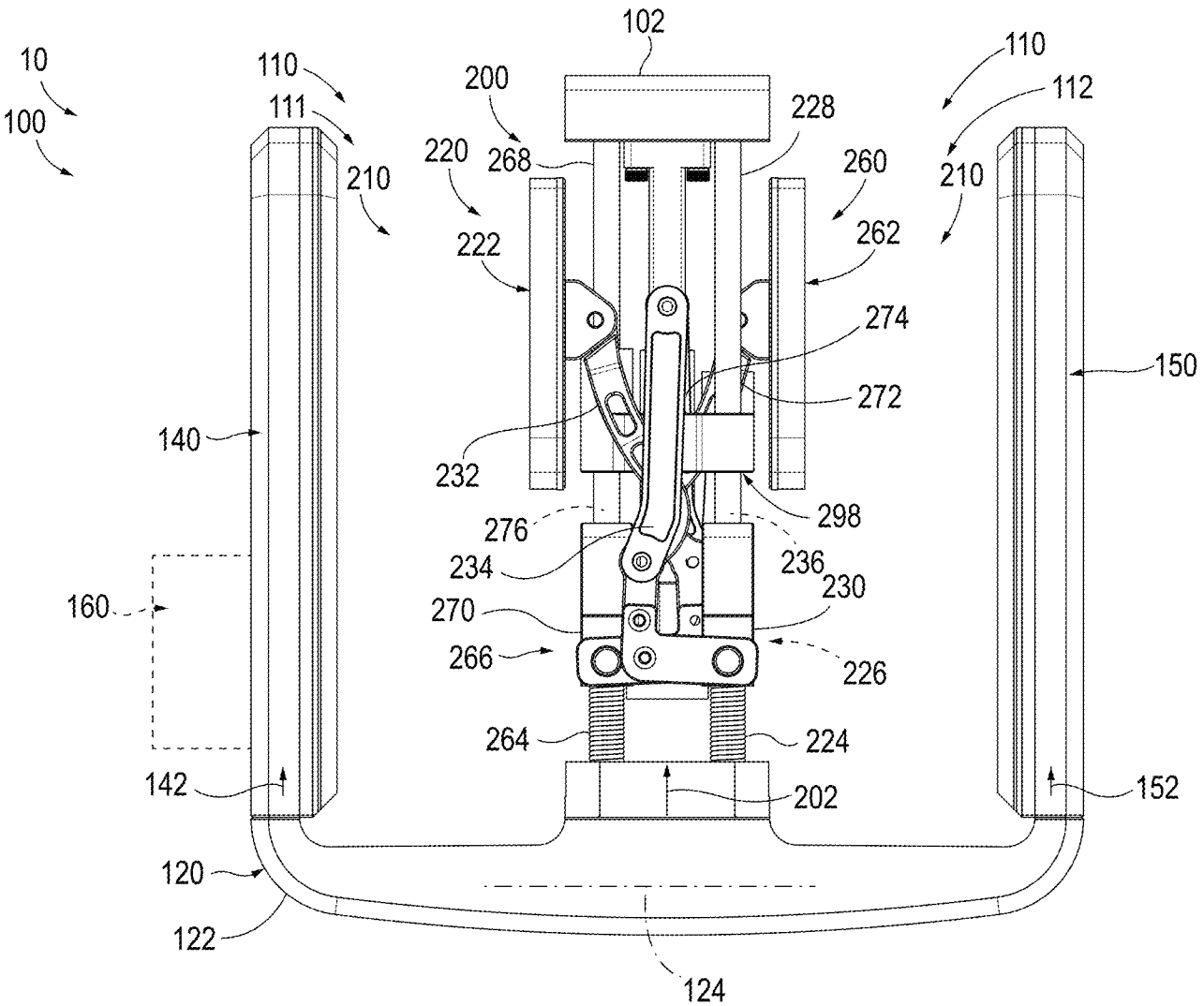
FIG. 6 is a side view of a portion of the watersports board rack of FIG. 5.
Figure 7:
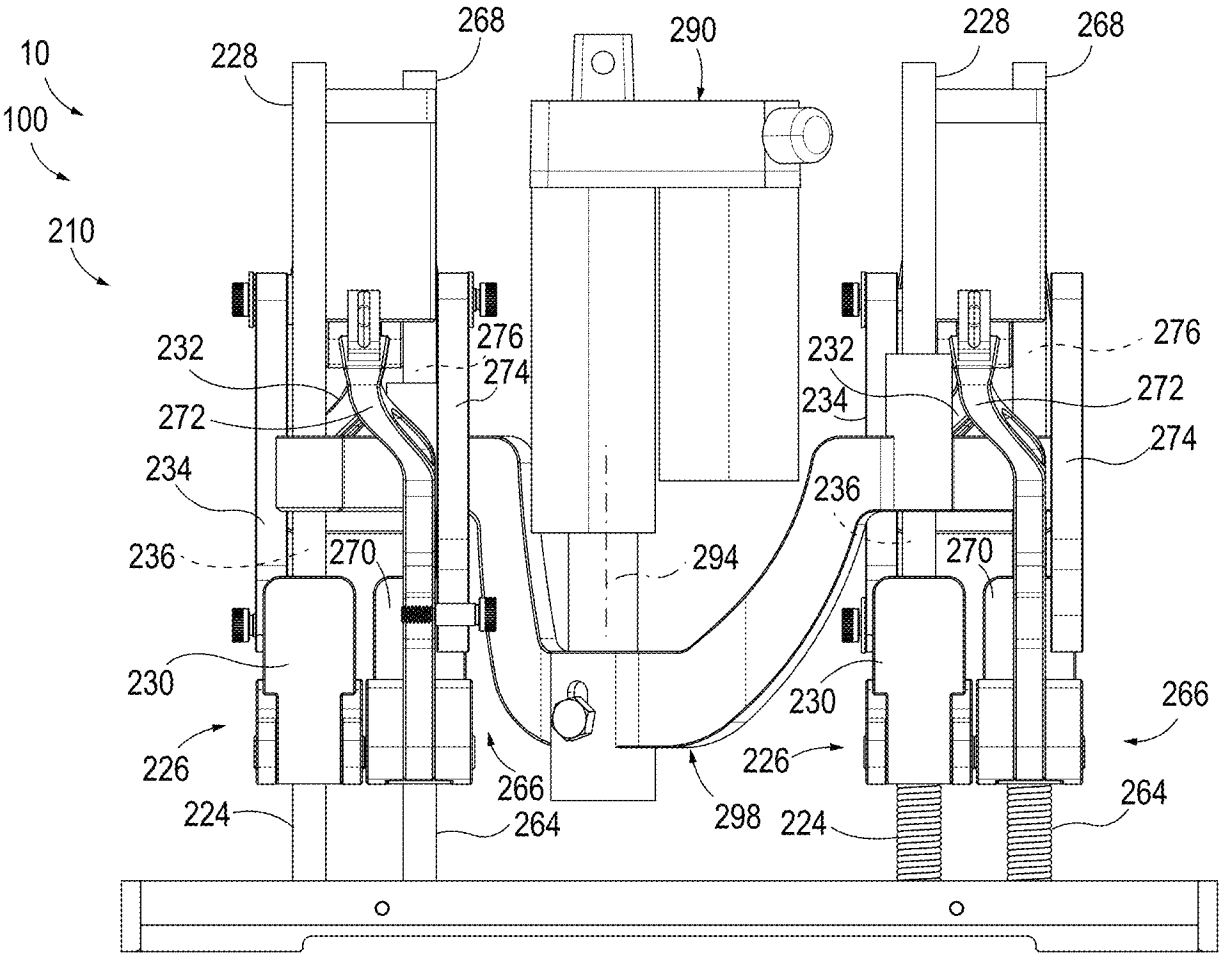
FIG. 7 is a front view of a portion of a retention structure of the watersports board rack of FIGS. 5-6.
Figure 9:
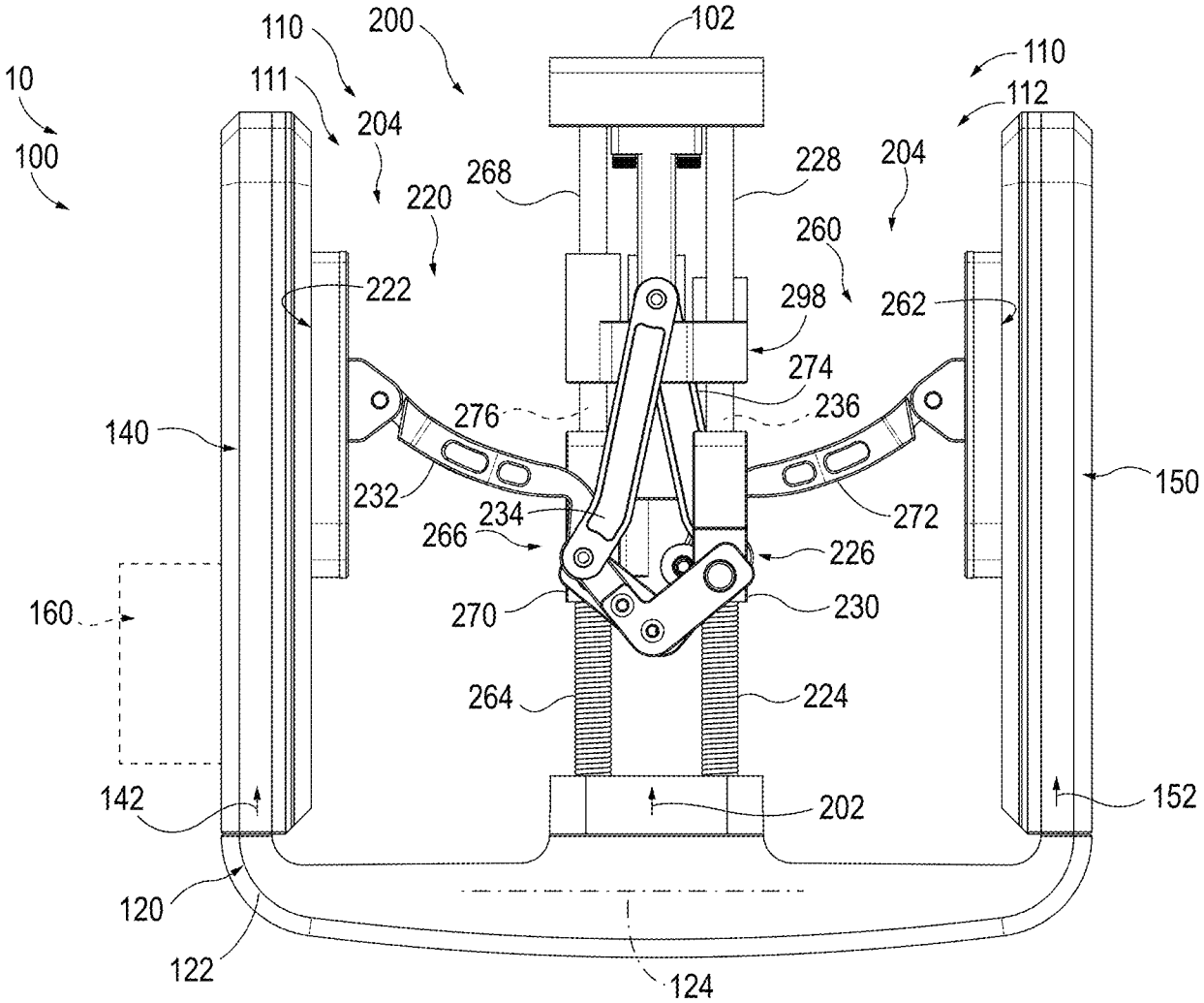
FIG. 9 is a side view of a portion of the watersports board rack of FIG. 8.
Figure 10:
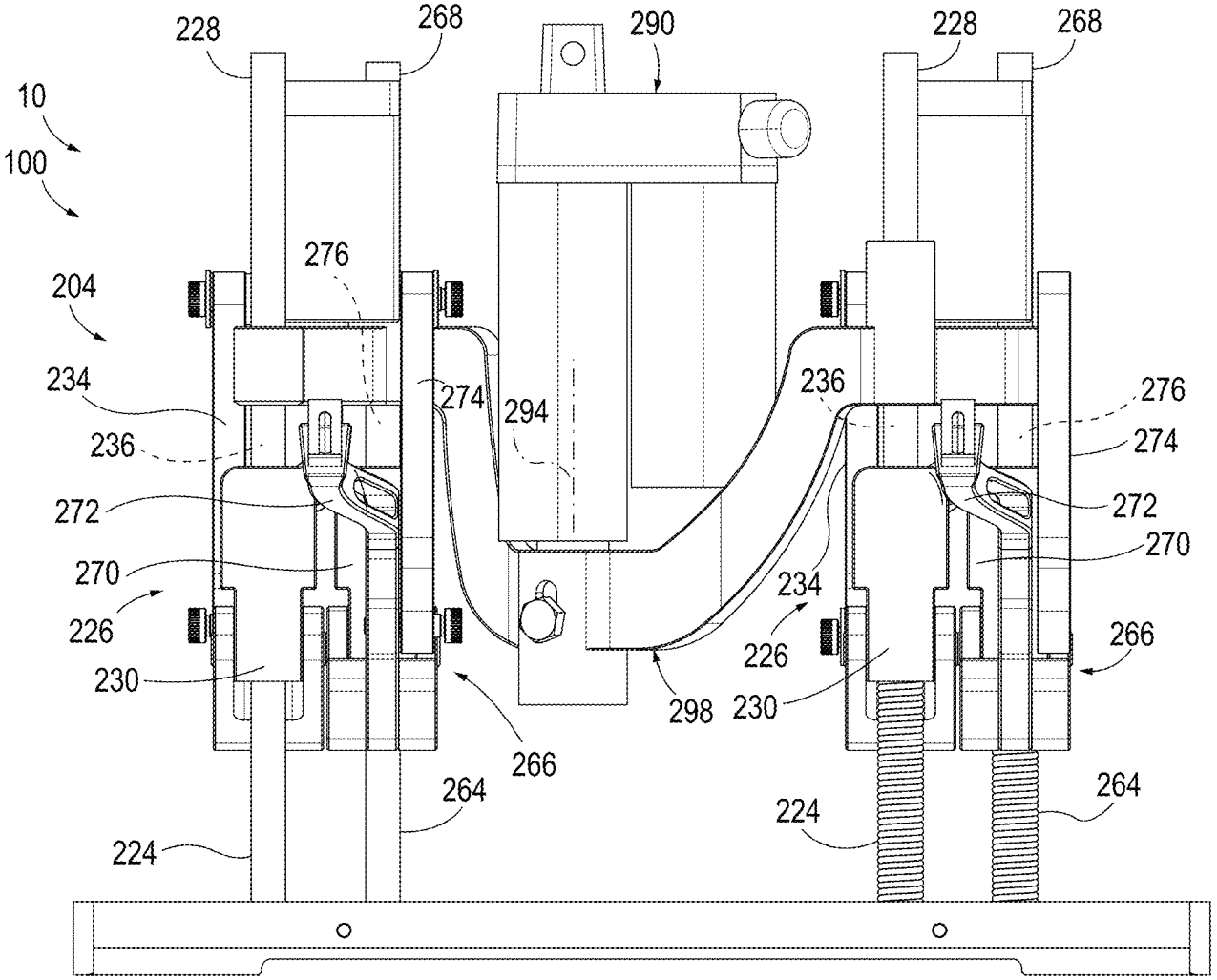
FIG. 10 is a front view of a portion of a retention structure of the watersports board rack of FIGS. 8-9.

In some examples, electrical actuator 290 may be configured to simultaneously compress the pair of first engagement pad biasing mechanisms 224 and the pair of second engagement pad biasing mechanisms 264 to transition retention structure 200 from the retained configuration to the released configuration. This is illustrated, for example, by the change from the configuration that is illustrated in FIGS. 9-10 to the configuration that is illustrated in FIGS. 6-7. This may permit and/or facilitate concurrent release of watersports boards 20 retained in both board-receiving regions 110.

Similarly, electrical actuator 290 may be configured to simultaneously release the pair of first engagement pad biasing mechanisms 224 and the pair of second engagement pad biasing mechanisms 264 to transition retention structure 200 from the released configuration to the retained configuration. This is illustrated, for example, by the change from the configuration that is illustrated in FIGS. 6-7 to the configuration that is illustrated in FIGS. 9-10. This may permit and/or facilitate concurrent retention of watersports boards 20 in both board-receiving regions 110. In addition, and because the first retention force is applied by the pair of first engagement pad biasing mechanisms and the second retention force is applied by the pair of second engagement pad biasing mechanisms, the magnitude of the first retention force and the magnitude of the second retention force may be controlled and/or regulated via selection and/or resilient properties of the corresponding engagement pad biasing mechanisms.

Electrical actuator 290 may include any suitable structure that may be adapted, configured, designed, and/or constructed to electrically transition retention structure 200 between the retained configuration and the released configuration. Examples of electrical actuator 290 include a linear actuator, a lead screw and nut assembly, a rack and pinion assembly, an electric motor, a servo motor, and/or a stepper motor.

It is within the scope of the present disclosure that electrical actuator 290 may include and/or be a single electrical actuator. Stated differently, the single electrical actuator may, or may be utilized to, transition an entirety of retention structure 200, including first engagement structure 220 and second engagement structure 260, between retained configuration 204 and released configuration 210. Stated still differently, a single action, motion, and/or member of linear actuator 290 may, or may be utilized to, transition the entirety of the retention structure between the retained configuration and the released configuration.

In some examples, and as perhaps best illustrated in FIGS. 1-4, board rack 100, retention structure 200, and/or electrical actuator 290 may include a switch 292. Switch 292 may be configured to be actuated, such as by the user of board rack 100; and electrical actuator 290 may be configured to actuate retention structure 200 between the retained configuration and the released configuration responsive to actuation of the switch.

In some examples, a single switch 292, such as a single pole double throw switch, may be utilized to actuate retention structure 200 and/or electrical actuator 290 thereof both from the retained configuration to the released configuration and from the released configuration to the retained configuration. In other examples, a pair of switches 292, such as a pair of single pole single throw switches, may be utilized. In such a configuration, actuation of a first switch of the pair of switches may cause the retention structure to transition from the retained configuration to the released configuration and actuation of a second switch of the pair of switches may cause the retention structure to transition from the released configuration to the retained configuration. In some examples, switch 292 may include and/or be a latching switch. Such a configuration may permit and/or facilitate complete actuation of the retention structure between the retained configuration and the released configuration responsive to a single, or a momentary, actuation of the switch by a user of the board rack. In some examples, switch 292 may include and/or be a momentary switch. Such a configuration may permit and/or facilitate selection of an extent of actuation of the retention structure by the user.

In a specific example, switch 292 may be a momentary switch, and board rack 100, retention structure 200, and/or electrical actuator 290 may be configured to transition, or to completely transition, from one of the retained configuration and the released configuration to the other of the retained configuration and the released configuration responsive to a single and/or momentary actuation of the switch. As an example, and when the retention structure currently is in the retained configuration, a single and/or momentary actuation of the switch may cause the retention structure to transition from the retained configuration to the released configuration. As another example, and when the retention structure is currently in the released configuration, a single and/or momentary actuation of the switch may cause the retention structure to transition from the released configuration to the retained configuration.

As discussed in more detail herein, board racks 100 and/or retention structures 200 thereof may be configured to apply the retention force with the predetermined retention force magnitude independent of the thickness of the watersports board. As such, the above-described complete actuation from the released configuration to the retained configuration may be performed without, or without fear of, damage to the watersports board via application of overly strong retention forces to the watersports board.

With continued reference to FIGS. 1-4, and in some examples, board rack 100 may include lighting 180. Lighting 180, when present, may be configured to illuminate at least one region of board rack 100, such as board-receiving region 110, including first board-receiving region 111 and/or second board-receiving region 112. An example of lighting 180 includes light emitting diodes (LEDs) and/or a strip of LEDs.

In some examples, lighting 180 may be configured to turn on, or to automatically turn on, responsive to actuation of retention structure 200 between the retained configuration and the released configuration. This may permit and/or facilitate improved viewing of and/or access to board-receiving region 110. Additionally or alternatively, this may provide a visual indication that retention structure 200 has been actuated.

In some examples, lighting 180 may be configured to turn off, or to automatically turn off, responsive to, or after, a threshold inactivity time in which the retention structure is not transitioned between the retained configuration and the released configuration. This may decrease battery usage and/or drainage by lighting 180.

It is within the scope of the present disclosure that retention structure 200 may be configured to transition, or to automatically transition, from the released configuration to the retained configuration, such as may be responsive to one or more transition criteria. Examples of the transition criteria include expiration of a threshold released time in which the retention structure is in the released configuration, removal of the watercraft to which the board rack is attached from the water, starting of an engine of the watercraft, and/or transitioning of a transmission of the watercraft out of neutral, into forward, and/or into reverse. This may decrease a potential for the watersports boards to inadvertently fall out of the board rack should the user inadvertently forget to transition the retention structure to the retained configuration.

A specific example of watersports board racks 100, according to the present disclosure, and/or components thereof, is illustrated in FIGS. 5-10. In the example that is illustrated in FIGS. 5-10, retention structure 200 is configured to selectively transition between retained configuration 204, as illustrated in FIGS. 8-10, and released configuration 210, as illustrated in FIGS. 5-7. Retention structure 200 includes first engagement structure 220, including the pair of first engagement pads 222 biased via first engagement pad biasing mechanism 224, and second engagement structure 260, including the pair of second engagement pads 262 biased via second engagement pad biasing mechanism 264.

In the example of FIGS. 5-10, actuation of retention structure 200 is accomplished as follows. To transition retention structure 200 from retained configuration 204 to released configuration 210, electrical actuator 290 is extended along an extension axis 294, as perhaps best illustrated by the transition from the configuration that is illustrated in FIG. 10 to the configuration that is illustrated in FIG. 7. Extension of electrical actuator 290 causes the electrical actuator to urge a compression member 298 to compress, or to simultaneously compress, first engagement pad biasing mechanisms 224 and second engagement pad biasing mechanisms 264.

In particular, first engagement pad biasing mechanisms 224 are associated with and/or extend around a corresponding pair of first linear bearings 226, each of which includes a corresponding first rod 228 and a corresponding first sliding member 230. Similarly, second engagement pad biasing mechanisms 264 are associated with and/or extend around a corresponding pair of second linear bearings 266, each of which includes a corresponding second rod 268 and a corresponding second sliding member 270. Compression member 298 is operatively attached to first linear bearings 226 and also to second linear bearings 266, such as via first rods 228 and second rods 268, and compresses first engagement pad biasing mechanisms 224 and second engagement pad biasing mechanisms 264, such as via contact with first sliding members 230 and second sliding members 270.

In some examples, and as illustrated in dashed lines in FIGS. 3-4, 6-7, and 9-10, first linear bearings 226 may include a corresponding low-friction surface 236 and/or second linear bearings 266 may include a corresponding low-friction surface 276. Low-friction surfaces 236/276 may be positioned, or may decrease friction, between first rods 228 and/or second rods 268 and one or more other components of retention structure 200, such as to decrease a potential for sticking and/or incomplete actuation during actuation of the retention structure between the retained configuration and the released configuration. As more specific examples, the low-friction surface may surround first rods 228, may surround second rods 268, may be positioned between first rods 228 and first engagement pad biasing mechanisms 224, and/or may be positioned between second rods 268 and second engagement pad biasing mechanisms 264. Examples of low-friction surfaces 236/276 include a polymeric surface, a low-friction surface, a low surface energy surface, a polyoxymethylene surface, and/or a polytetrafluoroethylene surface.

As perhaps best illustrated in FIGS. 6-7 and 9, a pair of first sliding actuation arms 232 is pivotally attached at one end to a corresponding first sliding member 230 and at the other end to a corresponding first engagement pad 222 (not pictured in FIGS. 7 and 10). Similarly, a pair of second sliding actuation arms 272 is pivotally attached at one end to a corresponding second sliding member 270 and at the other end to a corresponding second engagement pad 262 (not pictured in FIGS. 7 and 10).

In addition, a pair of first pivoting actuation arms 234 is pivotally attached at one end to a central region of first sliding actuation arms 232 and at the other end to a housing 102 of board rack 100 (not pictured in FIGS. 7 and 10). Similarly, a pair of second pivoting actuation arms 274 is pivotally attached at one end to a central region of second sliding actuation arms 272 and at the other end to the housing of the board rack.

Thus, extension of electrical actuator 290 along extension axis 294, such as from the configuration that is illustrated in FIGS. 9-10 to the configuration that is illustrated in FIGS. 6-7, causes compression member 298 to urge first sliding members 230 and second sliding members 270 downward (in the orientation that is illustrated in FIGS. 6-7 and 9-10). This causes first pivoting actuation arms 234 and second pivoting actuation arms 274 to direct first sliding actuation arms 232 and second sliding actuation arms 272, respectively, to pivot toward and/or into retention structure 200, thereby transitioning the retention structure to the released configuration.

To transition retention structure 200 from released configuration 210 to retained configuration 204, electrical actuator 290 is retracted along extension axis 294, as perhaps best illustrated by the transition from the configuration that is illustrated in FIGS. 6-7 to the configuration that is illustrated in FIGS. 9-10. Retraction of electrical actuator 290 permits first engagement pad biasing mechanisms 224 and second engagement pad biasing mechanisms 264 to expand and urge first sliding members 230 and second sliding members 270 upward (in the orientation that is illustrated in FIGS. 6-7 and 9-10). This causes first pivoting actuation arms 234 and second pivoting actuation arms 274 to direct first sliding actuation arms 232 and second sliding actuation arms 272, respectively, to pivot outward and/or into the first board-receiving region and the second board-receiving region, respectively, thereby transitioning the retention structure to the retained configuration.

As perhaps best illustrated in FIGS. 9-10, and when in retained configuration 204, compression member 298 is spaced-apart from first sliding members 230 and also from second sliding members 270 along a length of corresponding first rods 228 and second rods 268, respectively. Stated differently, compression member 298 is not attached to the first sliding members and/or to the second sliding members. As such, the first retention force that is applied to the first watersports board and/or the second retention force that is applied to the second watersports board are generated solely by first engagement pad biasing mechanisms 224 and second engagement pad biasing mechanisms 264, respectively. Thus, and as discussed herein, the magnitude of the retention forces may be controlled and/or regulated. Stated differently, electrical actuator 290 does not generate, or contribute to, first retention force 206 and/or second retention force 208, decreasing a potential for application of retention forces of a magnitude that could be damaging to corresponding watersports boards.

The present disclosure also is directed to methods of operating watersports board racks, such as watersports board racks 100 that are disclosed herein. These methods include selectively actuating an electrical actuator of the watersports board racks, such as to selectively transition a retention structure of the watersports board rack between a retained configuration and a released configuration. When in the retained configuration, the retention structure is configured to apply a retention force to a watersports board to retain the watersports board within a board-receiving region of the watersports board rack. When in the released configuration, the retention structure is configured to release the retention force from the watersports board, such as to permit and/or facilitate separation of the watersports board from the watersports board rack.

In some examples, the selectively actuating may include selectively transitioning the watersports board rack from the retained configuration to the released configuration via compression of an engagement pad biasing mechanism of the retention structure. In some examples, the selectively actuating may include selectively transitioning the watersports board rack from the released configuration to the retained configuration by permitting expansion of the engagement pad biasing mechanism. In some examples, the retention force may be generated solely by the engagement pad biasing mechanism.

Examples of the electrical actuator are disclosed herein with reference to electrical actuators 290. Examples of the retention structure and/or components thereof are disclosed herein with reference to retention structures 200. Examples of the retained configuration are disclosed herein with reference to retained configuration 204. Examples of the released configuration are disclosed herein with reference to released configuration 210. Examples of the retention force are disclosed herein with reference to first retention force 206 and/or second retention force 208. Examples of the board-receiving region are disclosed herein with reference to board-receiving regions 110. Examples of the watersports board are disclosed herein with reference to watersports boards 20. Examples of the engagement pad biasing mechanism are disclosed herein with reference to first engagement pad biasing mechanism 224 and/or second engagement pad biasing mechanism 264.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, "at least substantially," when modifying a degree or relationship, may include not only the recited "substantial" degree or relationship, but also the full extent of the recited degree or relationship. A substantial amount of a recited degree or relationship may include at least 75% of the recited degree or relationship. For example, an object that is at least substantially formed from a material includes objects for which at least 75% of the objects are formed from the material and also includes objects that are completely formed from the material. As another example, a first length that is at least substantially as long as a second length includes first lengths that are within 75% of the second length and also includes first lengths that are as long as the second length.

Illustrative, non-exclusive examples of watersports board racks according to the present disclosure are presented in the following enumerated paragraphs. It is within the scope of the present disclosure that an individual step of a method recited herein, including in the following enumerated paragraphs, may additionally or alternatively be referred to as a "step for" performing the recited action.

A1. An electrically actuated watersports board rack configured to support watersports boards, the board rack comprising:

a first board-receiving region configured to receive a first watersports board;

optionally a second board-receiving region configured to receive a second watersports board; and a retention structure configured to be selectively actuated between a retained configuration, in which the retention structure is configured to apply a first retention force to the first watersports board to retain the first watersports board within the first board-receiving region and optionally also to apply a second retention force to the second watersports board to retain the second watersports board within the second board-receiving region, and a released configuration, in which the retention structure is configured to release the first retention force and optionally the second retention force;

wherein the retention structure includes an electrical actuator configured to selectively actuate the retention structure between the retained configuration and the released configuration.

A2. The board rack of paragraph A1, wherein the first board-receiving region is configured to receive the first watersports board in a horizontal, or at least substantially horizontal, first board orientation, and further wherein the second board-receiving region is configured to receive the second watersports board in a horizontal, or at least substantially horizontal, second board orientation.

A3. The board rack of any of paragraphs A1-A2, wherein the first board-receiving region is configured to receive the first watersports board in a vertical, or at least substantially vertical, first board orientation, and further wherein the second board-receiving region is configured to receive the second watersports board in a vertical, or at least substantially vertical, second board orientation.

A4. The board rack of any of paragraphs A1-A3, wherein the first board-receiving region is a U-shaped, or at least substantially U-shaped, first board-receiving region, and further wherein the second board-receiving region is a U-shaped, or at least substantially U-shaped, second board-receiving region.

A5. The board rack of any of paragraphs A1-A4, wherein the board rack includes:

(i) a base region, which at least partially defines both the first board-receiving region and the second board-receiving region;

(ii) a first projecting region, which extends from the base region and at least partially defines the first board-receiving region; and (iii) a second projecting region, which extends from the base region and at least partially defines the second board-receiving region.

A6. The board rack of paragraph A5, wherein the first projecting region extends from the base region in a first projection direction, wherein the second projecting region extends from the base region in a second projection direction, and further wherein the first projection direction and the second projection direction are parallel, or at least substantially parallel, to one another.

A7. The board rack of any of paragraphs A5-A6, wherein the retention structure at least one of:

(i) extends from the base region, optionally in a retention structure projection direction that is parallel, or at least substantially parallel, to at least one of a/the first projection direction and a/the second projection direction;

(ii) extends between, at least partially between, or directly between, the first projecting region and the second projecting region; and (iii) at least partially defines both the first board-receiving region and the second board-receiving region.

A8. The board rack of any of paragraphs A5-A7, wherein, when the retention structure is in the retained configuration, at least one of:

(i) the board rack is configured to apply a first compressive force to the first watersports board via the retention structure and the first projecting region; and (ii) the board rack is configured to apply a second compressive force to the second watersports board via the retention structure and the second projecting region.

A9 The board rack of paragraph A8, wherein at least one of:

(i) the first projecting region is a resilient first projecting region configured to limit a magnitude of the first compressive force; and (ii) the second projecting region is a resilient second projecting region configured to limit a magnitude of the second compressive force.

A10. The board rack of any of paragraphs A5-A9, wherein the base region is a first base region, and further wherein the board rack includes a second base region, wherein at least one of:

(i) a longitudinal axis of the first base region extends parallel, or at least substantially parallel, to a longitudinal axis of the second base region;

(ii) the second base region at least partially defines the first board-receiving region and the second board-receiving region;

(iii) the first projecting region extends from the second base region;

(iv) the second projecting region extends from the second base region; and (v) the retention structure extends from the second base region.

A11. The board rack of any of paragraphs A1-A10, wherein the retention structure is configured to apply the first retention force in a first retention force direction and to apply the second retention force in a second retention force direction that is opposed, or at least substantially opposed, to the first retention force direction.

A12. The board rack of any of paragraphs A1-A11, wherein the retention structure is configured to at least one of:

(i) apply the first retention force with a predetermined first retention force magnitude independent of a thickness of the first watersports board; and (ii) apply the second retention force with a predetermined second retention force magnitude independent of a thickness of the second watersports board.

A13. The board rack of any of paragraphs A1-A12, wherein the retention structure is configured to at least one of:

(i) direct the first retention force toward a/the first projecting region of the board rack; and (ii) direct the second retention force toward a/the second projecting region of the board rack.

A14. The board rack of any of paragraphs A1-A13, wherein the retention structure includes a first engagement structure, which is configured to selectively apply the first retention force to the first watersports board, and a second engagement structure, which is configured to selectively apply the second retention force to the second watersports board.

A15. The board rack of paragraph A14, wherein:

(i) the first engagement structure includes a pair of first engagement pads configured to contact the first watersports board to apply the first retention force to the first watersports board; and (ii) the second engagement structure includes a pair of second engagement pads configured to contact the second watersports board to apply the second retention force to the second watersports board.

A16. The board rack of paragraph A15, wherein:

(i) the retention structure further includes a pair of first engagement pad biasing mechanisms, wherein each first engagement pad of the pair of first engagement pads is independently biased to apply a corresponding fraction of the first retention force via a corresponding one of the pair of first engagement pad biasing mechanisms; and (ii) the retention structure further includes a pair of second engagement pad biasing mechanisms, wherein each second engagement pad of the pair of second engagement pads is independently biased to apply a corresponding fraction of the second retention force via a corresponding one of the pair of second engagement pad biasing mechanisms.

A17. The board rack of paragraph A16, wherein the electrical actuator is configured to simultaneously compress the pair of first engagement pad biasing mechanisms and the pair of second engagement pad biasing mechanisms to transition the retention structure from the retained configuration to the released configuration.

A18. The board rack of any of paragraphs A16-A17, wherein the retention structure includes a pair of first linear bearings, which is associated with the pair of first engagement pad biasing mechanisms, and a pair of second linear bearings, which is associated with the pair of second engagement pad biasing mechanisms.

A19. The board rack of paragraph A18, wherein the retention structure further includes a compression member, wherein the compression member is operatively attached to the electrical actuator, wherein the compression member is slidingly associated with the pair of first linear bearings and the pair of second linear bearings, and further wherein the electrical actuator is configured to simultaneously compress the pair of first engagement pad biasing mechanisms and A20. The board rack of paragraph A19, wherein each first linear bearing of the pair of first linear bearings includes a corresponding first rod and a corresponding first sliding member, wherein each second linear bearing of the pair of second linear bearings includes a corresponding second rod and a corresponding second sliding member.

A21. The board rack of paragraph A20, wherein the compression member is configured to simultaneously compress the pair of first engagement pad biasing mechanisms and the pair of second engagement pad biasing mechanisms via contact with the corresponding first sliding member of each first linear bearing and also via contact with the corresponding second sliding member of each second linear bearing.

A22. The board rack of any of paragraphs A20-A21, wherein the first linear bearing includes a corresponding first low-friction surface positioned between the corresponding first rod and a corresponding first engagement pad biasing mechanism, and further wherein the second linear bearing includes a corresponding second low-friction surface positioned between the corresponding second rod and the corresponding second engagement pad biasing mechanism.

A23. The board rack of any of paragraphs A20-A22, wherein the retention structure further includes a pair of first sliding actuation arms and a pair of second sliding actuation arms, wherein each first sliding actuation arm of the pair of first sliding actuation arms is pivotally attached at one end to a corresponding first sliding member and at the other end to a corresponding first engagement pad of the pair of first engagement pads, and further wherein each second sliding actuation arm of the pair of second sliding actuation arms is pivotally attached at one end to a corresponding second sliding member and is pivotally attached at the other end to a corresponding second engagement pad of the pair of second engagement pads.

A24. The board rack of paragraph A23, wherein the retention structure further includes a pair of first pivoting actuation arms and a pair of second pivoting actuation arms, wherein each first pivoting actuation arm of the pair of first pivoting actuation arms is pivotally attached at one end to a central region of a corresponding first sliding actuation arm and at the other end to a housing of the board rack, and further wherein each second pivoting actuation arm of the pair of second pivoting actuation arms is pivotally attached at one end to a central region of a corresponding second sliding actuation arm and at the other end to the housing of the board rack.

A25. The board rack of any of paragraphs A1-A24, wherein the electrical actuator includes at least one of a linear actuator and an electric motor.

A26. The board rack of any of paragraphs A1-A25, wherein the electrical actuator is a single electrical actuator.

A27. The board rack of any of paragraphs A1-A26, wherein the board rack further includes a switch configured to be actuated by a user of the board rack, wherein the electrical actuator is configured to actuate the retention structure between the retained configuration and the released configuration responsive to actuation of the switch.

A28. The board rack of any of paragraphs A1-A27, wherein the board rack further includes a mounting structure configured to operatively attach the board rack to a watercraft.

A29. The board rack of paragraph A28, wherein the mounting structure includes a pivot configured to permit the board rack to pivot between a stowed orientation and a deployed orientation.

A30. The board rack of paragraph A29, wherein the mounting structure further includes a lock configured to selectively retain the board rack in at least one of the stowed orientation and the deployed orientation.

A31. The board rack of any of paragraphs A1-A30, wherein the board rack further includes lighting, or LED lighting, configured to illuminate at least one of:

(i) at least a region of the board rack;

(ii) the first board-receiving region; and (iii) the second board-receiving region.

A32. The board rack of paragraph A31, wherein the lighting is configured to turn on responsive to actuation of the retention structure between the retained configuration and the released configuration.

A33. The board rack of any of paragraphs A31-A32, wherein the lighting is configured to turn off after a threshold inactivity time in which the retention structure is not transitioned between the retained configuration and the released configuration.

A34. The board rack of any of paragraphs A1-A33, wherein the retention structure is configured to automatically transition from the released configuration to the retained configuration at least one of:

(i) after a threshold released time in the released configuration;

(ii) responsive to a/the watercraft to which the board rack is attached being removed from the water;

(iii) responsive to an engine of the watercraft being started; and (iv) responsive to a transmission of the watercraft being transitioned out of neutral.

A35. The board rack of any of paragraphs A1-A34, wherein the board rack includes any suitable function, structure, and/or feature that is illustrated and/or described herein.

B1. A method of operating an electrically actuated watersports board rack, the method comprising:

selectively actuating an electrical actuator to selectively transition a retention structure of the watersports board rack between a retained configuration, in which the retention structure is configured to apply a retention force to a watersports board to retain the watersports board within a board-receiving region, and a released configuration, in which the retention structure is configured to release the retention force.

B2. The method of paragraph B1, wherein the selectively actuating includes selectively transitioning the watersports board rack from the retained configuration to the released configuration via compression of an engagement pad biasing mechanism of the retention structure.

B3. The method of any of paragraphs B1-B2, wherein the selectively actuating includes selectively transitioning the watersports board rack from the released configuration to the retained configuration via permitting expansion of an/the engagement pad biasing mechanism of the retention structure.

B4. The method of any of paragraphs B2-B3, wherein the retention force is generated solely by the engagement pad biasing mechanism.

B5. The method of any of paragraphs B1-B4, wherein the watersports board rack includes any suitable structure, function, and/or feature of any of the board racks of any of paragraphs A1-A35.

INDUSTRIAL APPLICABILITY

The board racks and methods disclosed herein are applicable to the watersports industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. An electrically actuated watersports board rack configured to support watersports boards, the board rack comprising:

a board-receiving region configured to receive a watersports board; and a retention structure configured to be selectively actuated between a retained configuration, in which the retention structure is configured to apply a retention force to the watersports board to retain the watersports board within the board-receiving region, and a released configuration, in which the retention structure is configured to release the retention force;

wherein the retention structure includes an electrical actuator configured to selectively actuate the retention structure between the retained configuration and the released configuration;

wherein the board-receiving region is a first board-receiving region, the watersports board is a first watersports board, and the retention force is a first retention force;

wherein:

(i) the watersports board rack includes a second board-receiving region configured to receive a second watersports board;

(ii) when in the retained configuration, the retention structure further is configured to apply a second retention force to the second watersports board to retain the second watersports board within the second board-receiving region; and (iii) when in the released configuration, the retention structure is configured to release both the first retention force and the second retention force;

wherein the retention structure includes a first engagement structure, which is configured to selectively apply the first retention force to the first watersports board, and a second engagement structure, which is configured to selectively apply the second retention force to the second watersports board;

wherein:

(i) the first engagement structure includes a pair of first engagement pads configured to contact the first watersports board to apply the first retention force to the first watersports board; and (ii) the second engagement structure includes a pair of second engagement pads configured to contact the second watersports board to apply the second retention force to the second watersports board; and wherein:

(i) the retention structure further includes a pair of first engagement pad biasing mechanisms, wherein each first engagement pad of the pair of first engagement pads is independently biased to apply a corresponding fraction of the first retention force via a corresponding one of the pair of first engagement pad biasing mechanisms; and (ii) the retention structure further includes a pair of second engagement pad biasing mechanisms, wherein each second engagement pad of the pair of second engagement pads is independently biased to apply a corresponding fraction of the second retention force via a corresponding one of the pair of second engagement pad biasing mechanisms.

2. The board rack of claim 1, wherein the retention structure is configured to apply the retention force with a predetermined retention force magnitude independent of a thickness of the watersports board.

3. The board rack of claim 1, wherein the board rack includes:

(i) a base region, which at least partially defines both the first board-receiving region and the second board-receiving region;

(ii) a first projecting region, which extends from the base region and at least partially defines the first board-receiving region; and (iii) a second projecting region, which extends from the base region and at least partially defines the second board-receiving region.

4. The board rack of claim 3, wherein the retention structure:

(i) extends from the base region;

(ii) extends at least partially between the first projecting region and the second projecting region; and (iii) at least partially defines both the first board-receiving region and the second board-receiving region.

5. The board rack of claim 3, wherein, when the retention structure is in the retained configuration, at least one of:

(i) the board rack is configured to apply a first compressive force to the first watersports board via the retention structure and the first projecting region; and (ii) the board rack is configured to apply a second compressive force to the second watersports board via the retention structure and the second projecting region.

6. The board rack of claim 1, wherein the retention structure is configured to apply the first retention force in a first retention force direction and to apply the second retention force in a second retention force direction that is at least substantially opposed to the first retention force direction.

7. The board rack of claim 1, wherein the electrical actuator is configured to simultaneously compress the pair of first engagement pad biasing mechanisms and the pair of second engagement pad biasing mechanisms to transition the retention structure from the retained configuration to the released configuration.

8. The board rack of claim 1, wherein the retention structure includes a pair of first linear bearings, which is associated with the pair of first engagement pad biasing mechanisms, and a pair of second linear bearings, which is associated with the pair of second engagement pad biasing mechanisms.

9. The board rack of claim 8, wherein the retention structure further includes a compression member, wherein the compression member is operatively attached to the electrical actuator, wherein the compression member is slidingly associated with the pair of first linear bearings and the pair of second linear bearings, and further wherein the electrical actuator is configured to simultaneously compress the pair of first engagement pad biasing mechanisms and the pair of second engagement pad biasing mechanisms via the compression member.

10. The board rack of claim 9, wherein each first linear bearing of the pair of first linear bearings includes a corresponding first rod and a corresponding first sliding member, wherein each second linear bearing of the pair of second linear bearings includes a corresponding second rod and a corresponding second sliding member.

11. The board rack of claim 10, wherein the compression member is configured to simultaneously compress the pair of first engagement pad biasing mechanisms and the pair of second engagement pad biasing mechanisms via contact with the corresponding first sliding member of each first linear bearing and also via contact with the corresponding second sliding member of each second linear bearing.

12. The board rack of claim 10, wherein the first linear bearing includes a corresponding first low-friction surface positioned between the corresponding first rod and a corresponding first engagement pad biasing mechanism, and further wherein the second linear bearing includes a corresponding second low-friction surface positioned between the corresponding second rod and a corresponding second engagement pad biasing mechanism.

13. The board rack of claim 10, wherein the retention structure further includes a pair of first sliding actuation arms and a pair of second sliding actuation arms, wherein each first sliding actuation arm of the pair of first sliding actuation arms is pivotally attached at one end to a corresponding first sliding member and at the other end to a corresponding first engagement pad of the pair of first engagement pads, and further wherein each second sliding actuation arm of the pair of second sliding actuation arms is pivotally attached at one end to a corresponding second sliding member and is pivotally attached at the other end to a corresponding second engagement pad of the pair of second engagement pads.

14. The board rack of claim 13, wherein the retention structure further includes a pair of first pivoting actuation arms and a pair of second pivoting actuation arms, wherein each first pivoting actuation arm of the pair of first pivoting actuation arms is pivotally attached at one end to a central region of a corresponding first sliding actuation arm and at the other end to a housing of the board rack, and further wherein each second pivoting actuation arm of the pair of second pivoting actuation arms is pivotally attached at one end to a central region of a corresponding second sliding actuation arm and at the other end to the housing of the board rack.

15. The board rack of claim 1, wherein the retention structure is configured to automatically transition from the released configuration to the retained configuration at least one of:

(i) after a threshold released time in the released configuration;

(ii) responsive to a watercraft to which the board rack is attached being removed from the water;

(iii) responsive to an engine of the watercraft being started; and (iv) responsive to a transmission of the watercraft being transitioned out of neutral.

16. A method of operating the electrically actuated watersports board rack of claim 1, the method comprising:

selectively actuating the electrical actuator to selectively transition the retention structure of the watersports board rack between the retained configuration and the released configuration;

wherein the selectively actuating includes selectively transitioning the watersports board rack from the retained configuration to the released configuration via compression of an engagement pad biasing mechanism of the retention structure;

wherein the selectively actuating includes selectively transitioning the watersports board rack from the released configuration to the retained configuration via permitting expansion of the engagement pad biasing mechanism of the retention structure; and wherein the retention force is generated solely by the engagement pad biasing mechanism.

* * * * *